US008127578B2

(12) United States Patent
Karcz et al.

(10) Patent No.: US 8,127,578 B2
(45) Date of Patent: Mar. 6, 2012

(54) LOCKING GATE LATCHES

(75) Inventors: Irek Karcz, Cromer (AU); Anthony John Clark, Cremorne (AU); Dezso Kiraly, Meadowbank (AU)

(73) Assignee: D & D Group Pty Ltd, French Forest, NSW (AU)

( * ) Notice: Subject to any disclaimer, the term of this patent is extended or adjusted under 35 U.S.C. 154(b) by 841 days.

(21) Appl. No.: 11/700,588

(22) Filed: Jan. 31, 2007

(65) Prior Publication Data

US 2007/0175250 A1 Aug. 2, 2007

(30) Foreign Application Priority Data

Jan. 31, 2006 (AU) ..... 2006900451

(51) Int. Cl.
*E05B 65/06* (2006.01)

(52) U.S. Cl. ..... 70/135; 70/102; 70/137; 70/139; 70/150; 70/484; 292/210; 292/216; 292/DIG. 13; 292/DIG. 37

(58) Field of Classification Search ..... 70/135–139, 70/484, 485, DIG. 73, 77, 101, 102, 95–97, 70/150, 151 R, 151 A, 154, 155; 292/194, 292/216, 219, 220, 224, 210, DIG. 13, DIG. 29, 292/DIG. 37, DIG. 46
See application file for complete search history.

(56) References Cited

U.S. PATENT DOCUMENTS

| | | | | |
|---|---|---|---|---|
| 204,267 | A | | 5/1878 | Unger |
| 2,313,712 | A | | 3/1943 | Jacobi |
| 2,767,007 | A | * | 10/1956 | Burke ..... 292/216 |
| 2,953,916 | A | | 9/1960 | Thomas |
| 3,040,555 | A | * | 6/1962 | Wartian ..... 70/97 |
| 3,115,026 | A | | 12/1963 | Moore |
| 3,433,518 | A | | 3/1969 | Foltz |
| 3,593,547 | A | | 7/1971 | Taylor |
| 3,677,591 | A | | 7/1972 | Waldo |
| 3,691,799 | A | * | 9/1972 | Hoffmann et al. ..... 70/84 |
| 3,705,505 | A | * | 12/1972 | Landow et al. ..... 70/99 |
| 3,785,186 | A | | 1/1974 | Hanson |
| 4,014,192 | A | | 3/1977 | Dillon et al. |
| 4,073,520 | A | * | 2/1978 | Tsuchiya et al. ..... 292/216 |
| 4,378,684 | A | | 4/1983 | Dugan et al. |
| 4,414,828 | A | * | 11/1983 | Takinami et al. ..... 70/84 |
| 4,691,541 | A | | 9/1987 | McQuade et al. |
| 4,732,418 | A | | 3/1988 | Crown et al. |
| 4,919,463 | A | | 4/1990 | McQuade, Sr. |
| 4,938,508 | A | | 7/1990 | Thomas |
| 5,024,473 | A | | 6/1991 | McQuade |

(Continued)

FOREIGN PATENT DOCUMENTS

FR 2405347 6/1979

*Primary Examiner* — Lloyd Gall
(74) *Attorney, Agent, or Firm* — Fulwider Patton LLP

(57) ABSTRACT

A gate latch is adapted to be installed on a gate post and a complementary striker arm is secured typically to a gate so that, upon closure of the gate, the striker arm engages a displacable latching element mounted in a housing of the latch to displace the latching element. The latching element is biased towards its open position but when the striker arm engages with the latching element it is displaced, thereby releasing an interference portion of a biased locking element, whereby the locking element is released to move under its biasing into a locking position so that self-locking is provided for the latch. A rotary release mechanism may be actuated to return the locking element so that the latching element can be released to release the striker bar and the gate may be opened.

11 Claims, 9 Drawing Sheets

U.S. PATENT DOCUMENTS 5,063,764 A 11/1991 Amis et al.
5,103,658 A 4/1992 McQuade
5,358,292 A 10/1994 Van Wiebe et al.
6,058,747 A 5/2000 Doyle et al.
6,347,819 B1 2/2002 Plaxco
6,513,351 B2 2/2003 Clark

* cited by examiner

LOCKING GATE LATCHES

FIELD OF THE INVENTION

The present invention relates to latches for gates and doors and more particularly is concerned with a latch of the type wherein a displaceable element (usually called a tongue) has a latching shoulder to engage with a striker arm with respect to which it is relatively moveable, the tongue having a striker surface adapted to engage with the striker arm to displace the tongue to permit engagement of the striker arm behind the latching shoulder. Typically, the biasing of the tongue will be under gravity, for example through a pivotal mounting and there is an arrangement to permit the tongue to be displaced to release the striker arm whereby a gate or door is then released to be moved relative to a gate post or door post.

The field of the invention extends to devices having spring biased tongues as well as gravity biased tongues and, in addition, extends to tongues which are both gravity and spring biased.

BACKGROUND OF THE INVENTION

Various forms of latches and, in particular, gravity latches, have been previously proposed such as U.S. Pat. No. 6,058,747 (Doyle) and U.S. Pat. No. 6,513,351 (Clark), both of which are assigned to the assignees of the present invention. These two US patents disclose specific developments in the field of latches for gates and doors. Other known prior latches in the field of those referred to as references in the printed specifications of the two US patents mentioned above. The prior art listed comprises:

| | |
|---|---|
| 204,267 | Unger |
| 2,313,712 | Jacobi |
| 2,953,916 | Thomas |
| 3,115,026 | Moore |
| 3,433,518 | Foltz |
| 3,593,547 | Taylor |
| 3,677,591 | Waldo |
| 3,785,186 | James et al |
| 3,838,877 | Hanson |
| 4,014,192 | Dillon et al |
| 4,378,684 | Dugan et al |
| 4,691,541 | McQuade et al |
| 4,732,418 | Crown et al |
| 4,919,463 | McQuade, Sr. |
| 4,938,508 | Thomas |
| 5,024,473 | McQuade |
| 5,063,764 | Amis et al |
| 5,103,658 | McQuade |
| 5,358,292 | Van Wiebe et al |
| 6,058,747 | Doyle et al |
| 6,347,819 | Plaxco |

U.S. Pat. No. 6,058,747 (Doyle et al) has a disclosure of a gravity latch having an enshrouded tongue and the lock mounted to be accessible from the front face. The disclosure includes a rear actuator unit adapted to be mounted on the opposite or rear face of a gate post so that, subject to any unlocking required of the rear unit, the tongue can be raised by the rear actuator to release the striker arm so that the gate may be opened from the rear side.

U.S. Pat. No. 6,513,351 (Clark) is a development with cylinder locks provided in front and rear units and respectively key operated to rotate a locking element into and out of a locking position. In the locking position the gravity biased tongue is locked in a retaining position in which the associated striker arm is held in position.

The prior published specifications referred to above are mentioned as an illustration of the background but in doing so, no admission is made that any of the specifications form part of the common general knowledge in Australia or any other geographical region.

In this specification, unless the context requires otherwise, the word "comprising" is used in the non exhaustive sense and further features may be present in the arrangement described.

The present invention is directed to new and useful alternatives to known arrangements.

SUMMARY OF THE INVENTION

According to a first aspect of the invention there is broadly provided a latch comprising:

(a) a housing in which (b) a displaceable latching element is mounted to be rotatable around a first axis of rotation from a latching position towards an open position in which a striker arm independent of the latch is released, and (c) the latching element having a latching shoulder adapted to retain the striker arm when engaged behind the latching shoulder and having an engagement surface adapted to be engaged by the striker arm when the striker arm and latching element are brought together to rotate the latching element and for permitting relative movement of the striker arm to adopt a position behind the latching shoulder, (d) a locking element for locking the latching element and mounted to be rotatable around a second axis of rotation between a locked position, in which the latching element is restrained from moving, and an unlocked position in which the latching element is free to be moved, one of the axis of rotation being displaced from the other axis of rotation in a direction radial to the other axis, (e) the locking element being biased towards the locking position, (f) the latching element being biased towards an open position, (g) the latching element having an interference portion which operates when the latching element has been displaced away from the latching position to prevent the locking element returning to its locking position, (h) whereby when the arm engages the latching element, the latching element is rotated thereby releasing the interference portion from the locking element whereby the locked element is released to move into the locking position so that a self locking arrangement is provided.

According to a second aspect of the invention there is broadly provided a latch comprising:

(a) a housing in which (b) a displaceable latching element is mounted to be displaceable from a latching position towards an open position in which a striker arm independent of the latch is released, and (c) the latching element having a latching shoulder adapted to retain the striker arm when engaged behind the latching shoulder and having an engagement surface adapted to be engaged by the striker arm when the striker arm and the latching element are brought together to displace the latching element and for permitting relative movement of the striker arm to adopt a position behind the latching shoulder, (d) a locking element mounted to be rotatable around an axis of rotation for locking the latching element and adapted to be rotated between a locked position, in which the latching element is restrained from moving, and an unlocked position in which the latching element is free to be moved, (e) the locking element being biased towards the locked position, (f) the latching element being biased towards an open position, (g) the latching element having an interference portion which operates when the latching element has been displaced away from the latching position to prevent the locking element returning to its locking position, (h) the locking element having first and second radially extending projections spaced apart along the axis, one of the projections having a side face for engaging the interference portion of the latching element, an aperture being defined between the projections for accommodating, whereby in the latching position of the latching element the projecting tab is retained in the aperture, (i) whereby the striker arm engages the latching element, the latching element is displaced thereby releasing the interference portion from the locking element whereby the locking element is released to move into the locked position so that a self locking arrangement is provided.

According to a third aspect of the present invention, there is broadly provided a latch for holding closed a gate (or door) wherein the latch is adapted to co-operate with a striker arm, the latch comprising:

(a) a housing in which (b) a displaceable latching element is mounted to be displaceable from a latching position towards an open position in which the striker arm is released for gate opening, and (c) the latching element having a latching shoulder to retain the striker arm when engaged behind the latching shoulder and having an engagement surface adapted to be engaged by the striker arm when the gate is moved towards a closed position to displace the latching element and for permitting relative movement of the striker arm to adopt a position behind the latching shoulder, (d) a locking element for locking the latching element and adapted to be displaced between a locking position, in which the latching element is restrained from moving, and a displaced position in which the latching element is free to be moved, (e) the locking element being biased towards the locking position, (f) the latching element being biased towards an open position, (g) the latching element having an interference portion which operates when the latching element has been displaced away from the latching position to prevent the locking element returning to its locking position, and (h) the arrangement being such that when a striker arm engages the latching element upon closure of an associated gate, the latching element is displaced thereby releasing the interference portion from the locking element whereby the locking element is released to move into the locking position so that a self locking arrangement is provided.

The housing may mount a lock having key actuation to displace the locking element in a rotary sense. The lock may be a cylinder lock with the locking element being in the form of a rotor, which may be rotatable through about 20° between its locking position and its displaced position.

The rotor may have first and second radially extending projections, the rearward of the projections having a side free for engaging the interference portion of the latching element, the side face being in a radial plane displaced around the axis of the rotor compared with a central radial plane around which the forward of the projections extends, an aperture being defined between the projections for accommodating a projecting tab of the latching element, whereby in the closed position of the latching element is retained by the projecting tab in the aperture.

The latch may be used with a remote actuator unit adapted to be mounted on the opposite side of the door or gate to the latch. The latch may incorporate the lock which can directly drive the locking element and the remote actuator may also have a key-operated lock so that either lock may unlock the latch.

Alternatively either the latch or remote actuator may have a key-operated lock and the other may have a manually actuated device for releasing the latch so that the door or gate can be opened. The manual actuator may be a button or emergency exit type crash bar.

The latching element can be biased suitably. One embodiment is upward biasing by a spring but magnetic, gravity or other biasing may be used. The locking element could be an arranged above or below the location at which in use the striker bar will present itself to the latching element.

Embodiments of the invention lend themselves to being used with a cylinder lock and the locking element being in the form of a rotor which is rotatable and mounted coaxially with the axis of the cylinder lock.

The latching element can be plate-like and can be substantially wholly enclosed for pivotal movement about a horizontal axis within the housing, a spring being provided for biasing the latching element towards the open position. However the latching element need not be pivotal or arranged as in this embodiment. For example the latching element may be of the nature of a sliding plate in a guide with a profiled exposed portion to function as a cam surface when engaged by the striker arm for displacement of the latching element during latching and self locking engagement.

Embodiments of the invention lend themselves to co operation with an optional rear actuator unit adapted to be mounted on the opposite side of a gate post to that of the latch. For this purpose the locking element is structured so that it can move relative to a base portion of the housing and the base portion of the housing is adapted to receive therethrough an actuating element associated with the rear actuator unit for operating the mechanism and in particular moving the locking element from the locking position and a displaced position. This may be achieved by providing a rotatable lock, such as a cylinder lock, in the rear unit and which drives a coupling bar which is in engagement with the locking element to rotate it from the locking position to the displaced position.

Where an egress mechanism is required in the rear operating unit, it may be in the form of a depressible actuator, for example in the form of a button or the like which moves in a guide towards the associated gate post, its motion being translated through a mechanical arrangement to provide rotary drive to move the latching element so that unlocking is achieved and the gate may be opened. For example a rack and pinion or worm and nut or similar mechanism may be used.

The embodiments illustrated are for normal operation of a key-operated lock. However, other embodiments may be configured by having remote electrical operation of either lock.

Other features and advantages of the invention will become apparent from the following detailed description, taken in conjunction with the accompanying drawings which illustrate, by way of example, the features of the invention

BRIEF DESCRIPTION OF THE DRAWINGS

An embodiment of the invention will now be described with reference to the accompanying drawings, of which.

DETAILED DESCRIPTION OF THE PREFERRED EMBODIMENTS

Figure 1:
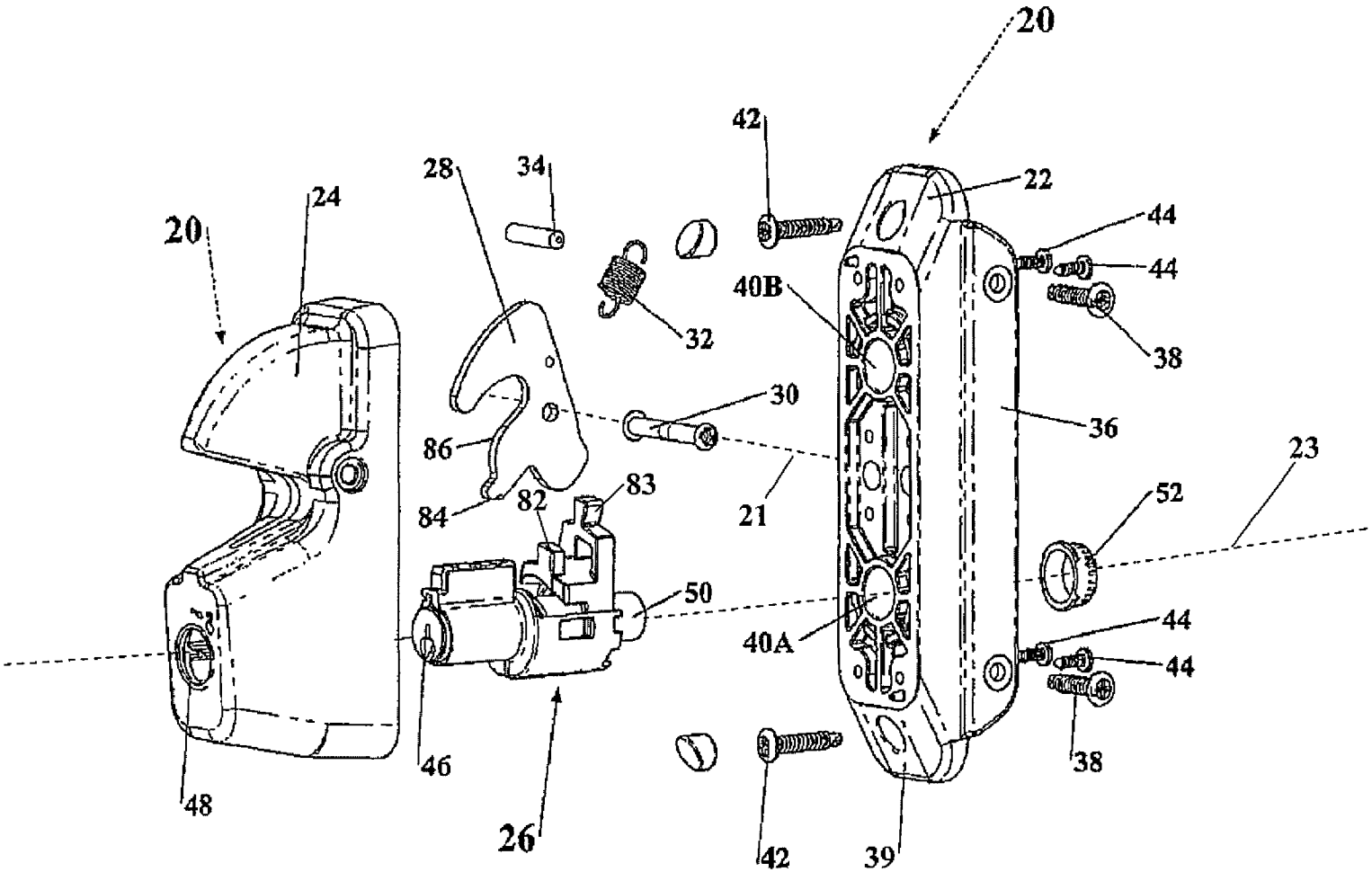
FIG. 1 is an exploded view of a front unit for a latch embodying the invention.

Referring first to the exploded view of FIG. 1, the front unit for a latch assembly is illustrated. It is adapted to cooperate in use with a striker arm assembly, which is independent of the latch, shown in FIG. 2 and optionally to be employed with a rear access unit shown in exploded view in FIG. 4. As shown in FIG. 1, the latch unit comprises a housing 20 assembled from a base unit 22 and a front shell 24 within which is mounted a locking cartridge assembly 26 for cooperation with a pivotal latching tongue 28. The tongue is mounted in the shell 24 on a pivot pin 30 located on a first axis of rotation 21 and the tongue is adapted to be biased upwardly to its open position by a helical extension spring 32 which, at its upper end, is mounted on a mounting pin 34 and, at its lower end, is connected directly to the tongue.

The base 22 is generally L shaped in plan view and has a side leg 36 adapted to be engaged over the face of a structure such as a gate post and secured to the gate post by screws 38. A main leg 39 of the base is symmetrical with two vertically spaced apertures 40A and 40B and this leg is also adapted to be secured to the gate post by upper and lower screws 42. The shell 24, when the components are assembled inside, is fitted to the base by a series of four screws 44 from the rear of the base into the shell 24 with a manually operated actuator, in this embodiment in the form of a cylinder lock 46 of the cartridge engaged in a corresponding aperture 48 in the shell and a rear barrel portion 50 of the cartridge engaged in the lower aperture 40A.

So that the gate latch can be fitted to either left hand or right hand opening gates, the unit can be reassembled with the base 22 rotated through 180° so that the opening 40B is lower and adapted to be engaged by the barrel 50.

Figure 2:
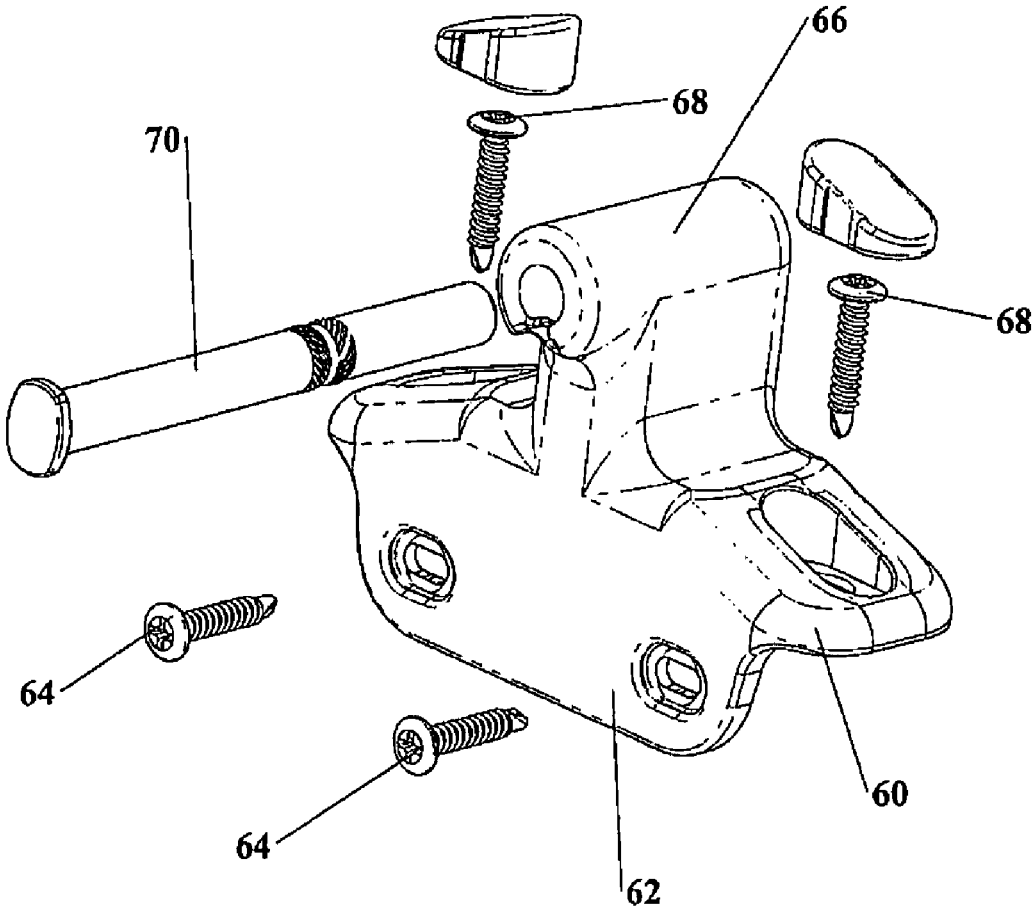
FIG. 2 is an exploded view of a complementary latching arm intended to be fitting to a gate.

The striker pin unit of FIG. 2 is adapted to be fixed to an edge portion of a gate and for that purpose has an L shaped striker bracket 60 with a side leg 62 adapted to be secured to a side face of the gate by two fixing screws 64 and the other leg of the bracket has an integral upstanding body portion 66 also adapted to be secured to the gate but through a front face by two screws 68. The body portion mounts a steel striker pin 70.

Figure 3:
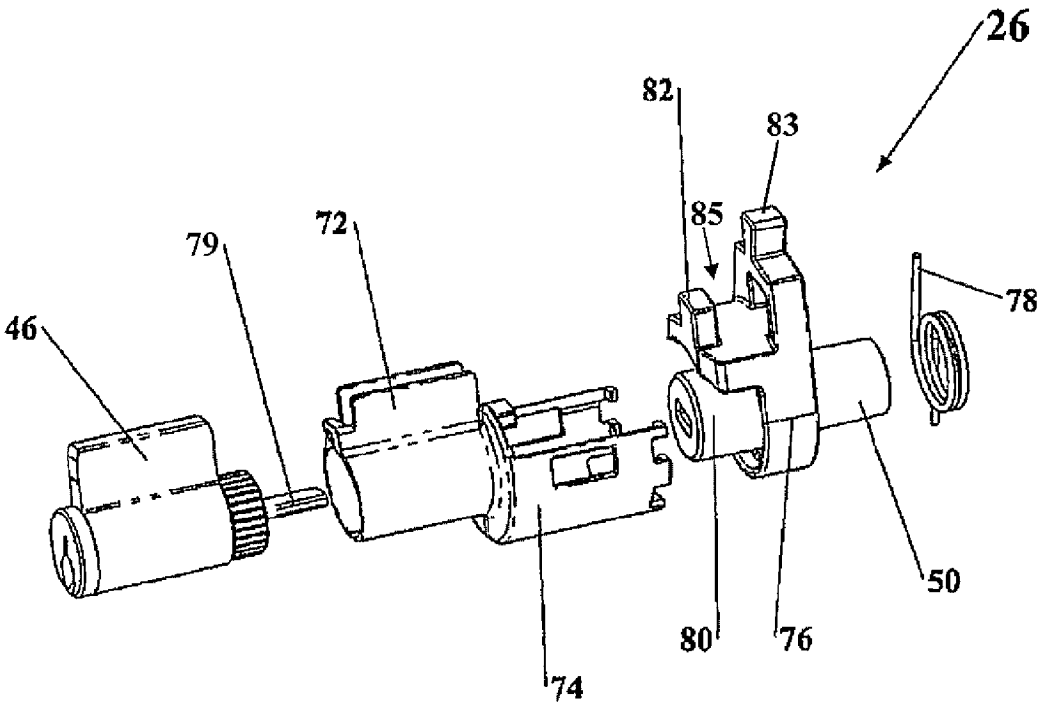
FIG. 3 is an exploded view of a cartridge assembly for the lock unit of FIG. 1.

FIG. 3 shows details of the cartridge 26 which comprises a plastic moulded holder 72 having a cylindrical portion at one end to accommodate the cylinder lock 46 and a part cylindrical coaxial portion 74 for accommodating a locking element in the form of a rotor 76. The rotor is mounted to be rotated around a second axis of rotation 23. The second axis of rotation is displaced from the first axis of rotation in a direction radial to the first axis 21. A torsion spring 78 mounts over the rearwardly extending barrel 50, the barrel having a square shaped ariel aperture for accommodating a square actuation bar of a rear unit described below. Upon assembly, the torsion spring is mounted to bias the rotor anti clockwise as seen in FIG. 1 and FIG. 3 towards its locking position. The rotor has a front barrel 80 with a rectangular axial slot accommodating a conventional flat operating bar 79 extending from the cylinder lock 46. The cylinder lock conventionally has a degree of lost motion so that initial turning by a key does not turn the bar 79 or the rotor but further action in a clockwise sense (as seen in FIG. 1 and FIG. 3) then turns the rotor to disengage a tongue retaining finger 82 of the rotor to release the tongue 28 to move upwardly under the biasing of spring 32 thereby releasing a striker arm so that the associated gate may be opened. The torsion spring 78 then acts to urge the rotor anti clockwise (as seen in FIG. 1 and FIG. 3) until the side faces a projection in the form of a finger 82 (one of two such fingers, the other being 83) inter engages with a side face of the tongue 28 thereby holding the latch mechanism to be armed with the striker pin when the gate is closed.

For this purpose, the tongue 28 has a projecting tab in the form of a protruding leg 84 (see FIG. 1) which interferes with the side of the finger 82 when the tongue is in the closed position. The profile of the tongue includes an abutment shoulder 86 configured such that when impacted by the striker arm 70, the tongue is rotated anticlockwise as seen in FIG. 1 to move the leg 84 rearwardly of the location of the finger 82, thereby releasing the rotor to turn under the force of the torsion spring 78 in an anticlockwise direction so that locking is automatically achieved.

An aperture 85 is defined between the projections 82 and 83 for accommodating the projecting tab of the latching element, whereby in the latching position of the latching element the projecting tab is retained in the aperture.

Figure 5:
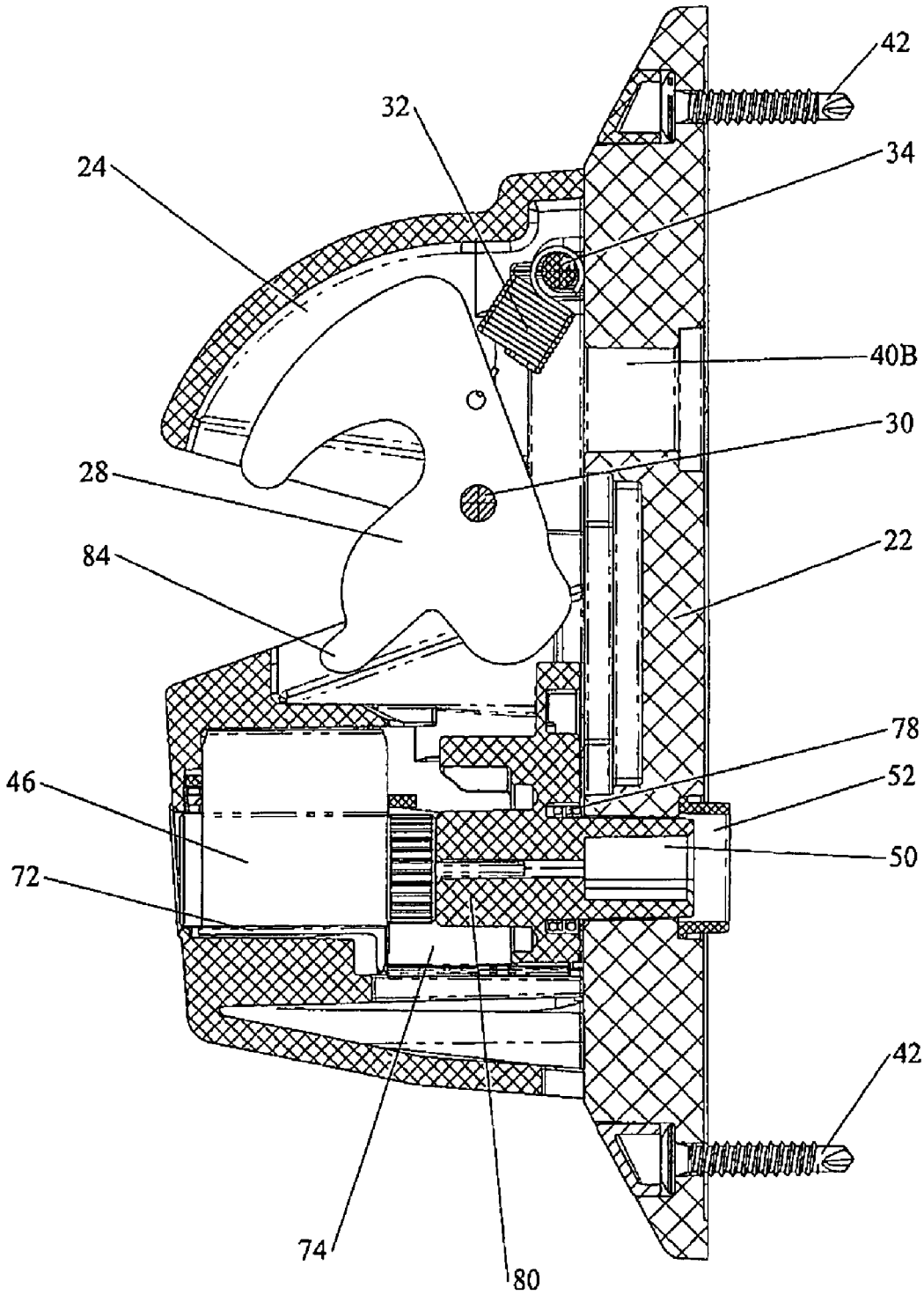
FIG. 5 is a cross sectional view through the front unit showing the tongue in a latching position but prior to engagement with a striker bar.
Figure 6:
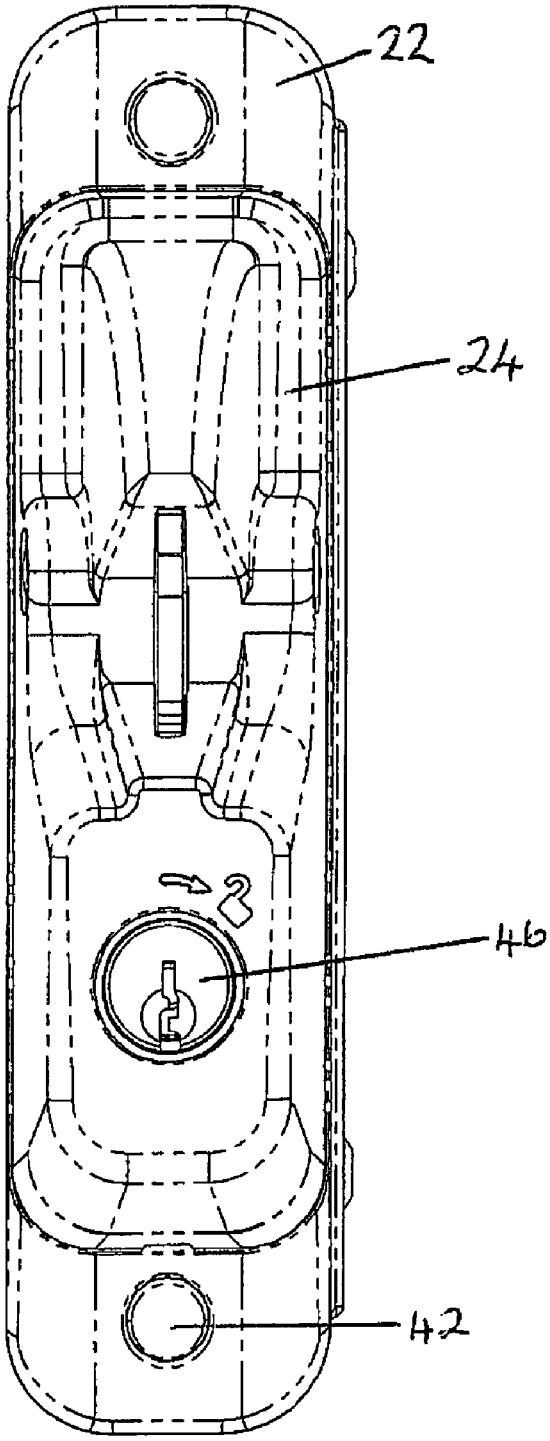
FIG. 6 is a front elevation of the front unit of FIG. 5.
Figure 7:
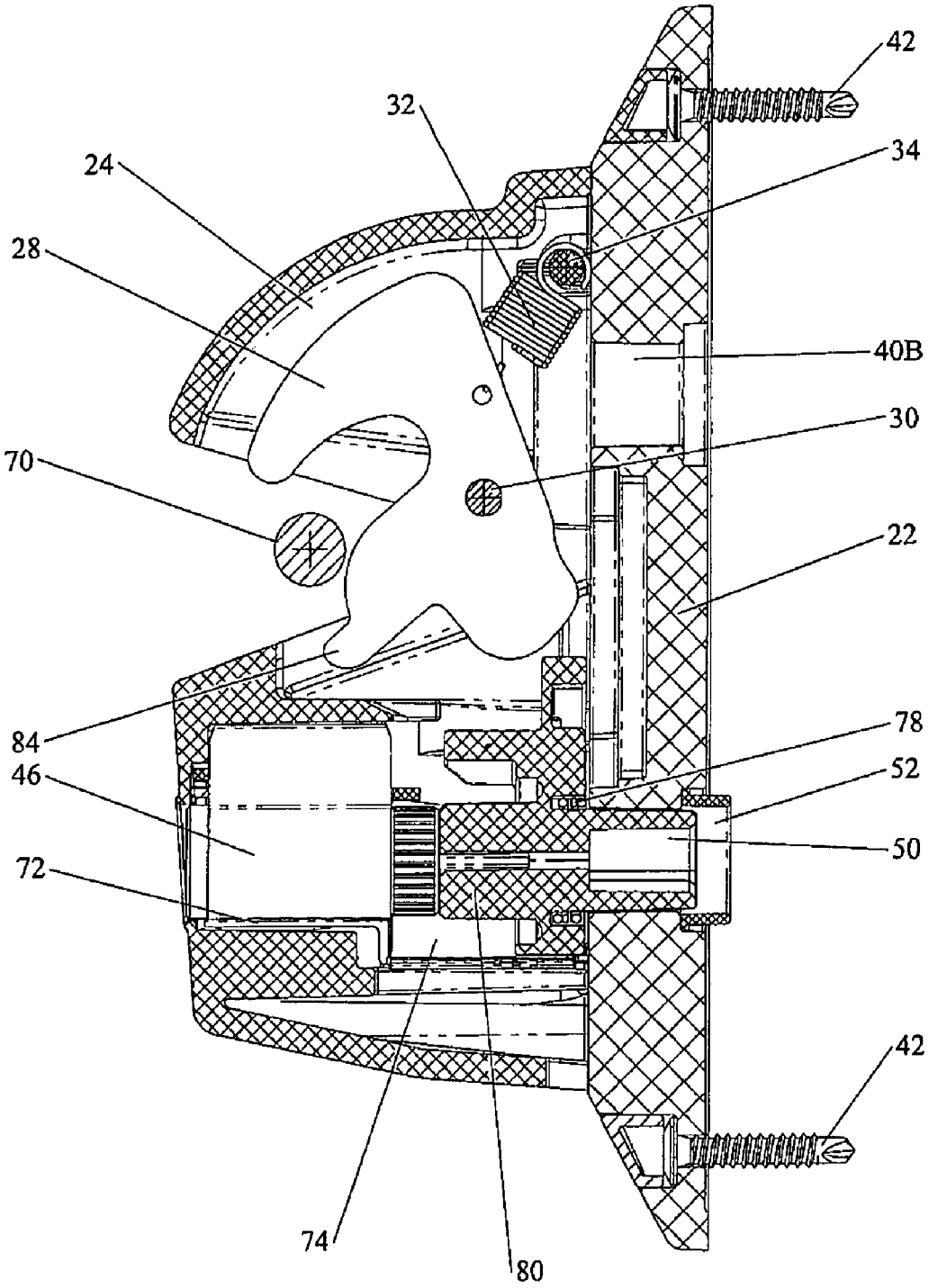
FIG. 7 is a view corresponding with FIG. 5 showing engagement by a striker bar.
Figure 8:
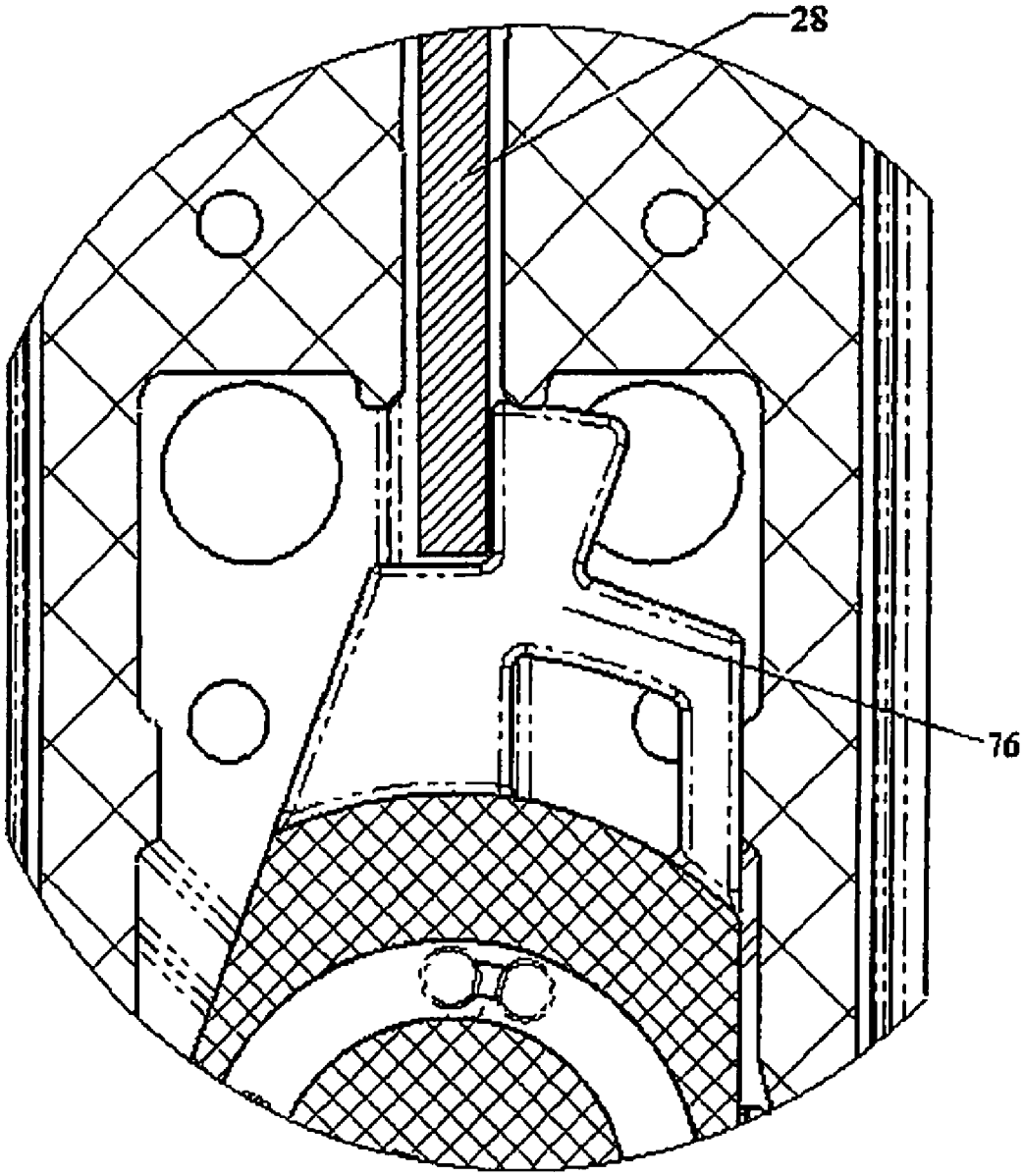
FIG. 8 is a part sectional view on an enlarged scale taken in a plane at right angles to the axis of the cylinder lock and rotor showing inter engagement between the tongue and the rotor prior to engagement of the striker bar, the rotor being held displaced from its final locking position.
Figure 9:
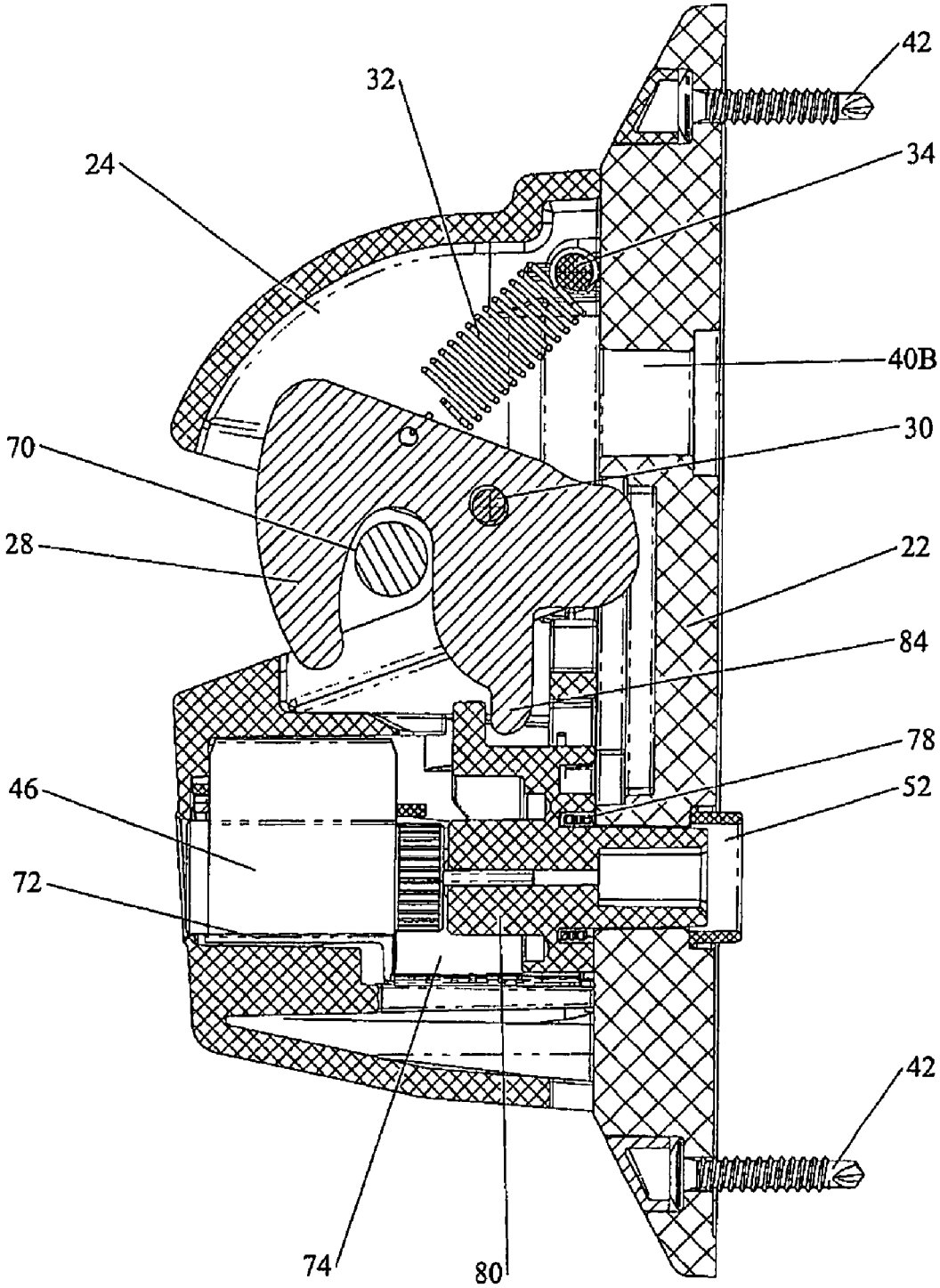
FIG. 9 corresponds with FIG. 7 but shows the components when in the locked position.

More detail of assembly is shown in FIG. 5 in which, for ease of reading the drawings, the extension spring 32 is shown not engaged with the tongue so it has fallen under gravity the position it will have adopted when pushed in an anticlockwise direction by a striker bar. FIG. 5 is a section in a central plane and shows the space around the leg 84 of the tongue, the side face of the tongue acting as an interference element for a side face of the finger 82 of the rotor (which is visible in FIG. 5).

Figure 4:
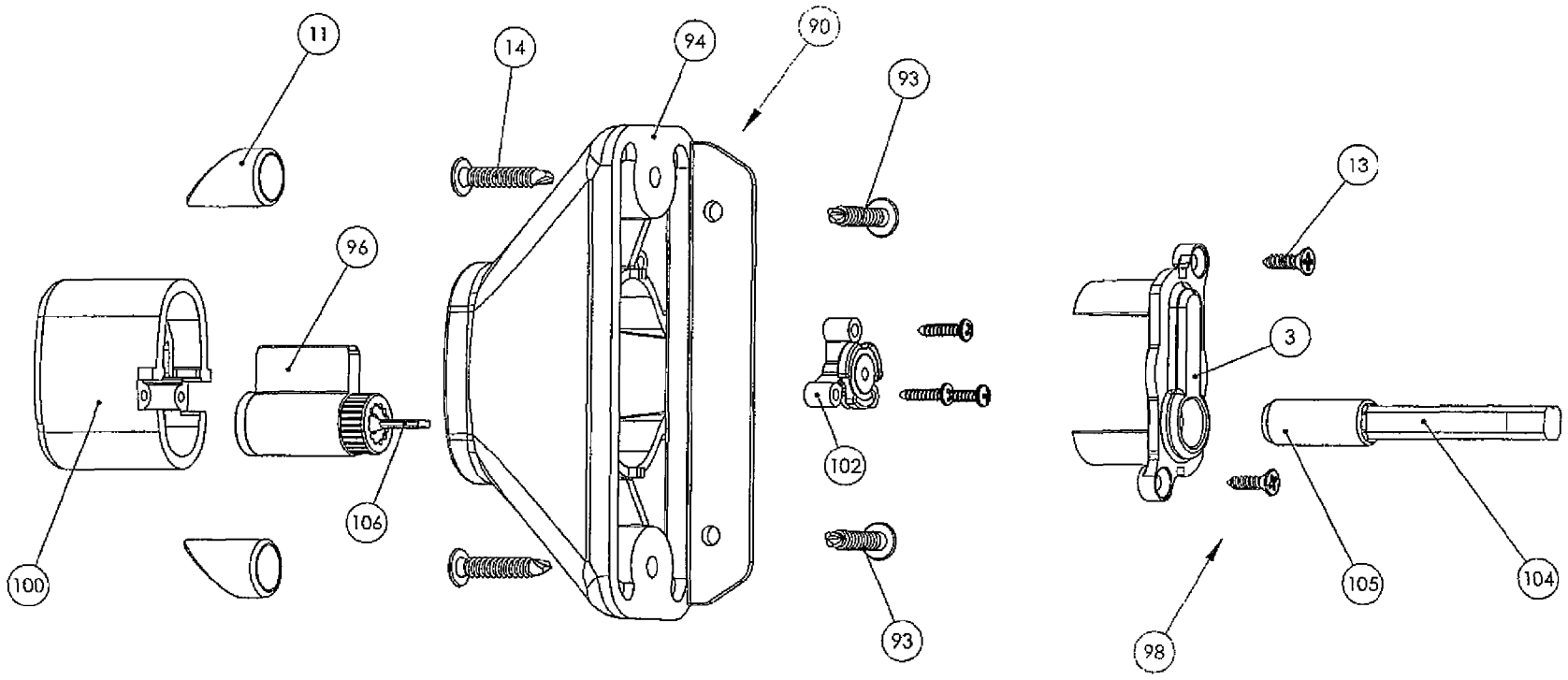
FIG. 4 is an exploded view of a rear access unit for use with the embodiment of FIG. 1.

Referring now to FIG. 4, the optional rear access unit has a housing 90 of general L shape and having a side leg 92 adapted to be fixed by screws 93 to the side of a gate and a casing 94 adapted to mount a lock 96 and an actuator assembly 98. The lock is mounted in a cap 100 which extends axially within a corresponding passage in the casing 94. The housing 90 also mounts a base element 102 to retain lock 96 in button 100. The actuating unit has a body portion 103 so that lock and button are biased to an outward position. The left hand end of the actuator comprises a barrel 105 having a rectangular slot into which the end of the operating bar 106 of the cylinder lock 96 engages for transmitting rotational force. The right hand end of the actuator 104 comprises a substantially square cross section drive bar for engaging in the barrel 50 of the rotor 76. Thus, by virtue of the lock 96 being a left hand operating lock, a key is rotated anti clockwise to take up initial lost motion and then further displaced to rotate the bar 104 clockwise when seen in the view of FIG. 4, whereby the rotor is rotated towards its opening position and can release the latching tongue to more upwardly under the spring bias.

In this embodiment the cap 100 is either not axially displaceable or, if axially displaceable, it is so by virtue of the bar 104 not fully penetrating the cavity in the rotor. In either event, any movement of the button if possible does not cause any function whatsoever but the structure described above has useful design criteria so that the unit may be useable in a second embodiment or, at least, many components of FIG. 4 are useable so that the manufacturer can cost effectively assemble and provide different embodiments for different market needs.

In summary, the embodiment described above lends itself to efficient robust construction with relative simplicity in terms of the number of components and assembly. Furthermore, an important aspect is ease of fitting with hand tools and handheld drills to gates and gate posts. A single aperture is all that is needed to extend between the rear wall and front wall of a gate post in order to mount the optional rear access unit to engage with and align with the front latch assembly. By contrast, if drillings are required at spaced parallel locations there is a great difficulty in achieving on site precision with hand tools.

We claim:

1. A latch comprising:

(a) a housing in which (b) a latching element is mounted to be rotatable around a first axis of rotation from a latching position towards an open position in which a striker arm independent of the latch is released, and (c) the latching element having a latching shoulder adapted to retain the striker arm when engaged behind the latching shoulder and having an engagement surface adapted to be engaged by the striker arm when the striker arm and the latching element are brought together to rotate the latching element and for permitting relative movement of the striker arm to adopt a position behind the latching shoulder, (d) a locking element for locking the latching element and mounted to be rotatable around a second axis of rotation between a locked position, in which the latching element is restrained from moving, and an unlocked position in which the latching element is free to be moved, one of the axis of rotation being displaced from the other axis of rotation in a direction radial to the other axis, (e) the locking element being biased towards the locked position, (f) the latching element being biased towards an open position, (g) the latching element having an interference portion which operates when the latching element has been displaced away from the latching position to prevent the locking element returning to its locked position, (h) whereby when the striker arm engages the latching element, the latching element is rotated thereby releasing the interference portion from the locking element whereby the locking element is released to move into the locked position so that a self locking arrangement is provided, (i) wherein the locking element has first and second projections extending radially from the second axis and spaced apart along the second axis, one of the projections having a side face for engaging the interference portion of the latching element, an aperture being defined between the projections for accommodating a projecting tab of the latching element, whereby in the latching position of the latching element the projecting tab is retained in the aperture.

2. A latch comprising:

(a) a housing in which (b) a displaceable latching element is mounted to be displaceable from a latching position towards an open position in which a striker arm independent of the latch is released, and (c) the latching element having a latching shoulder adapted to retain the striker arm when engaged behind the latching shoulder and having an engagement surface adapted to be engaged by the striker arm when the striker arm and the latching element are brought together to displace the latching element and for permitting relative movement of the striker arm to adopt a position behind the latching shoulder, (d) a locking element mounted to be rotatable around an axis of rotation for locking the latching element and adapted to be rotated between a locked position, in which the latching element is restrained from moving, and an unlocked position in which the latching element is free to be moved, (e) the locking element being biased towards the locked position, (f) the latching element being biased towards an open position, (g) the latching element having an interference portion which operates when the latching element has been displaced away from the latching position to prevent the locking element returning to its locked position, (h) the locking element having first and second radially extending projections spaced apart along the axis, one of the projections having a side face for engaging the interference portion of the latching element, an aperture being defined between the projections for accommodating the interference portion, whereby in the latching position of the latching element the interference portion is retained in the aperture, (i) whereby the striker arm engages the latching element, the latching element is displaced thereby releasing the interference portion from the locking element whereby the locking element is released to move into the locked position so that a self locking arrangement is provided.

3. A latch defined by claim 2 wherein the interference portion comprises a projecting tab.

4. A latch defined by claim 2 wherein the latch mounts a lock having key actuation to rotate the locking element.

5. A latch defined by claim 2 comprising an actuator located on the axis of rotation coupled to the locking element wherein the locking element is rotated by operation of the actuator.

6. A latch defined by claim 5 wherein in use the latch is mounted on a structure and the actuator is operable from each of opposing sides of the structure.

7. A latch defined by claim 6 wherein the actuator is coupled to a key operated lock.

8. A latch defined by claim 6 comprising a manually operated actuator, its motion being translated to provide drive to move the locking element to the unlocked position.

9. A latch as defined in claim 2 wherein the locking element is rotatable through about 20 degrees between its locked position and its unlocked position.

10. A latch as defined in claim 2, wherein the latching element is in the form of a generally planar element substantially wholly enclosed in the housing, a spring being provided for biasing the planar element towards the open position.

11. A latch as defined in claim 2, where the latch mounts a cylinder lock operationally coupled to the locking element.

* * * * *